US006817516B2

(12) United States Patent
VonNida et al.

(10) Patent No.: US 6,817,516 B2
(45) Date of Patent: Nov. 16, 2004

(54) BALLOT SECRECY SLEEVE

(76) Inventors: Mark A. VonNida, 155 N. Main St., Edwardsville, IL (US) 62025; Robert A. Jennings, 157 N. Main St., Edwardsville, IL (US) 62025

( * ) Notice: Subject to any disclaimer, the term of this patent is extended or adjusted under 35 U.S.C. 154(b) by 246 days.

(21) Appl. No.: 09/930,685

(22) Filed: Aug. 16, 2001

(65) Prior Publication Data

US 2003/0034386 A1 Feb. 20, 2003

(51) Int. Cl.[7] ..... G07C 13/00
(52) U.S. Cl. ..... 235/51; 281/29; 281/35; 281/36
(58) Field of Search ..... 235/51; 281/29, 281/35, 36

(56) References Cited

U.S. PATENT DOCUMENTS 3,169,029 A * 2/1965 Margolis ..... 281/29
4,431,924 A 2/1984 Suovaniemi et al. ..... 250/566
4,813,708 A 3/1989 Narey ..... 283/5
5,178,414 A * 1/1993 Small et al. ..... 281/35
5,575,505 A * 11/1996 Bridges ..... 281/36
5,681,113 A 10/1997 Rifken ..... 383/5
6,286,752 B1 * 9/2001 Heyer ..... 229/67.3

* cited by examiner

*Primary Examiner*—Karl D. Frech
(74) *Attorney, Agent, or Firm*—Don W. Weber

(57) ABSTRACT

A ballot secrecy sleeve is presented which is used to cover a ballot once it has been marked by the voter. The secrecy sleeve has a top and a bottom and a narrow shoulder at one end as well as a slot for pushing the ballot once it has been inserted into the ballot scanning machine. The ballot secrecy sleeve covers the entire ballot except for a small portion of the ballot that protrudes out of the secrecy sleeve. The ballot is placed within the sleeve. The ballot and sleeve are then placed into the scanning machine ballot slot. Once the ballot and sleeve are in place, the voter pushes the upper end of the ballot using the cutout so that the ballot is fed onto the receiving and advancing rollers of the machine. The ballot is then fed into the scanning and tabulating portion of the machine while it is completely hidden by either the ballot machine slot cover or the ballot secrecy sleeve. The secrecy sleeve is made of thick paper or light cardboard and preferably has a slick surface to facilitate the ballot slipping out of the sleeve as it is being advanced by the roller.

1 Claim, 4 Drawing Sheets

FIG. 4
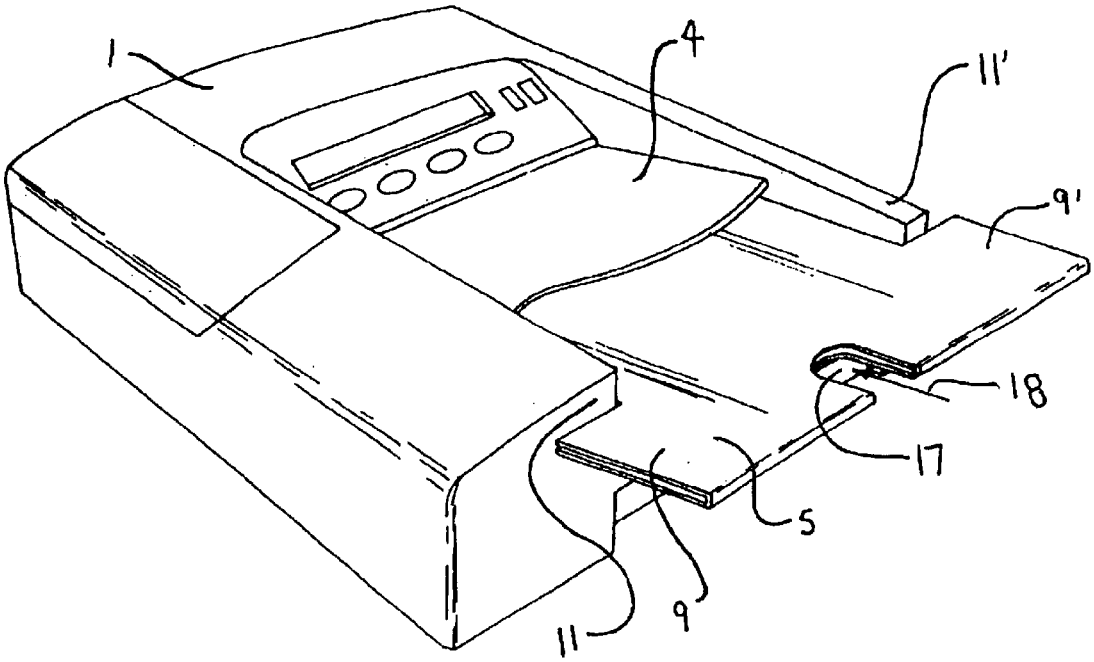
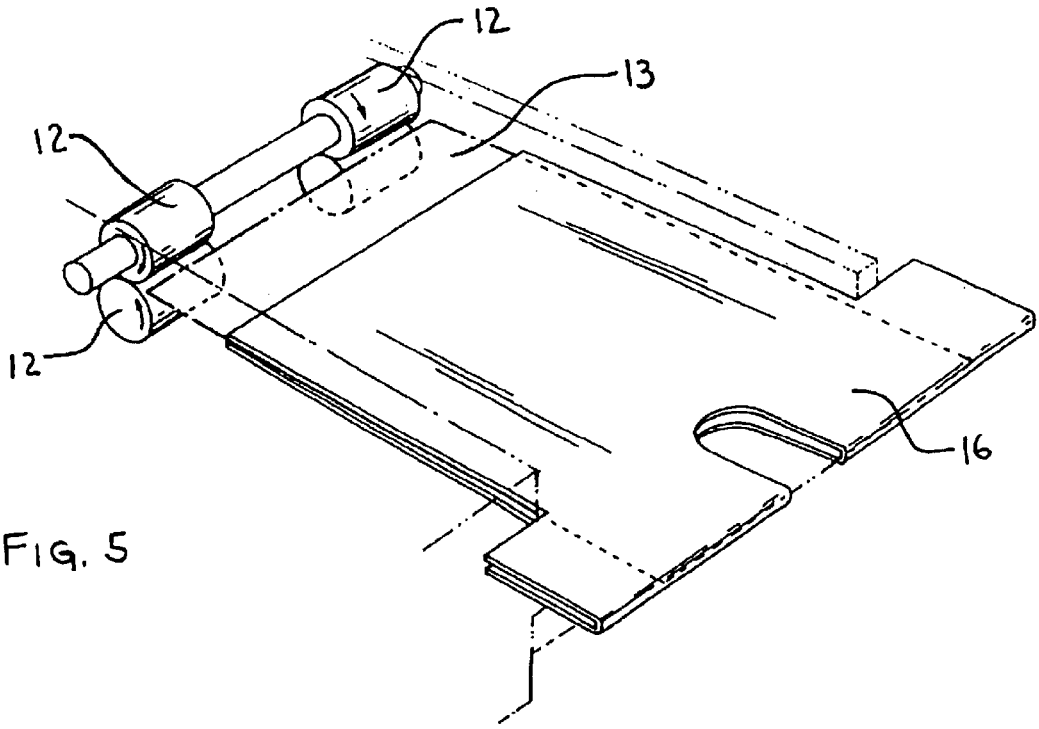
FIG. 5

BALLOT SECRECY SLEEVE

BACKGROUND OF THE INVENTION

This invention relates to the field of automated ballot tabulating machines. More particularly, a ballot secrecy sleeve is presented which covers the ballot as it is being fed into an automatic tabulating machine.

Through the years democracy has provided numerous ways of voting and tabulating vote counts. One of the earliest modem versions of voting mechanisms involved a paper ballot. On a paper ballot the names of the candidates are listed and a box is placed next to each candidates name. The voter simply marks an "x" in the appropriate box to vote for the candidate. These votes are then hand-counted after visual inspection and the tabulated count delivered to the proper election authority.

Since oftentimes tens of millions of votes need to be tabulated in order to determine the winner of a contest, much attention has been devoted to more sophisticated means of voting and tabulating the vote count. A particular improvement to the paper ballot method was thought to be the use of voter punch cards. In utilizing this type of voting apparatus, a punch card is inserted into a pre-determined matrix containing the candidates' names. The voter then punches through a chad in order to register his vote.

Unfortunately, punch cards resulted in a certain amount of error since the chad would occasionally not be punched all the way through or would be left hanging onto the back of the ballot to be tabulated. The use of punch cards has fallen into much disfavor since the recent problems with tabulating the correct vote in the Year 2000 Presidential Election in the State of Florida and elsewhere. Advancements are needed in order to more correctly count every vote.

A further advancement over the paper ballot or punch card ballot is the electronically scanned ballot. The electronically scanned ballot uses a ballot with a box or oval next to the candidate's name. However, rather than marking the appropriate box or oval with an "x" the voter simply fills in the oval so that the ballot can be scanned by an electronic scanning apparatus Once the voter has cast his vote, the ballot is fed into an electronic tabulating machine that easily and accurately tabulates the voter's preferences based on the ovals that were filled in during the balloting process. It is believed that the electronic scanning of ballots is much more accurate and less prone to human error or to other inaccurate and subjective methods of determining a voter's true intention.

However, with the advent of electronic balloting, the secrecy of the ballot has been compromised because the voter has to place his ballot into the ballot slot on the electronic tabulating machine. Even though this ballot slot has a secrecy cover, a portion of the ballot can still be viewed as it is being fed into the tabulating machine. If a bystander is able to view any portion of the ballot, he would be able to visually check the voter's candidate selections. This lack of secrecy is very disturbing to voters and to election officials who try to maintain the secrecy of the vote to the fullest extent possible.

There has thus become a need for some sort of secrecy protection device that would enable the voter to cast a ballot to be scanned in a completely secret method. It is an object of this invention to provide a method of protecting the secrecy of a ballot even when it is to be scanned by an electronic tabulating machine.

Since voting is done by a wide variety of eligible citizens, it is also important to keep the voting process itself as simple as possible. It is another object of this invention to provide a simple, yet effective, means of covering a voter's cast ballot until it is fed into the electronic tabulating machine.

Other and further objects of this invention will become apparent upon reading the below described Specification.

BRIEF DESCRIPTION OF THE DEVICE

A ballot secrecy sleeve is presented to protect the secrecy and privacy of a ballot once it has been marked by a voter. The sleeve comprises a cardboard cover which has an identical top and bottom connected by a narrow shoulder. The narrow shoulder has a small cutout to enable the voter to push the ballot into the tabulating mechanism once the ballot secrecy sleeve has been positioned in the ballot slot. The sleeve also has left and right flanges so that the sleeve and ballot can be placed into the ballot tabulating slot with the ballot being completely hidden either by the cover of the machine itself or by the secrecy sleeve. The left and right flanges insure that the ballot and sleeve are positioned in the ballot machine-receiving slot in the proper orientation. Once the ballot and sleeve have been properly positioned, the ballot is pushed into the tabulating machine using a cutout and the ballot receiving and advancing rollers advance the ballot out of the sleeve for tabulation. The ballot is completely hidden from the time the voter places it into the ballot secrecy sleeve until the time it is tabulated.

BRIEF DESCRIPTION OF THE DRAWINGS

FIG. 4 is a perspective view of the ballot-scanning machine, ballot secrecy sleeve and ballot as the ballot and sleeve are inserted into the scanning machine.

FIG. 5 is a partial cutaway view of the ballot machine mechanism showing the ballot receiving and advancing rollers immediately prior to the ballot being inserted between the rollers.

DETAILED DESCRIPTION OF THE PREFERRED EMBODIMENT

Figure 1:
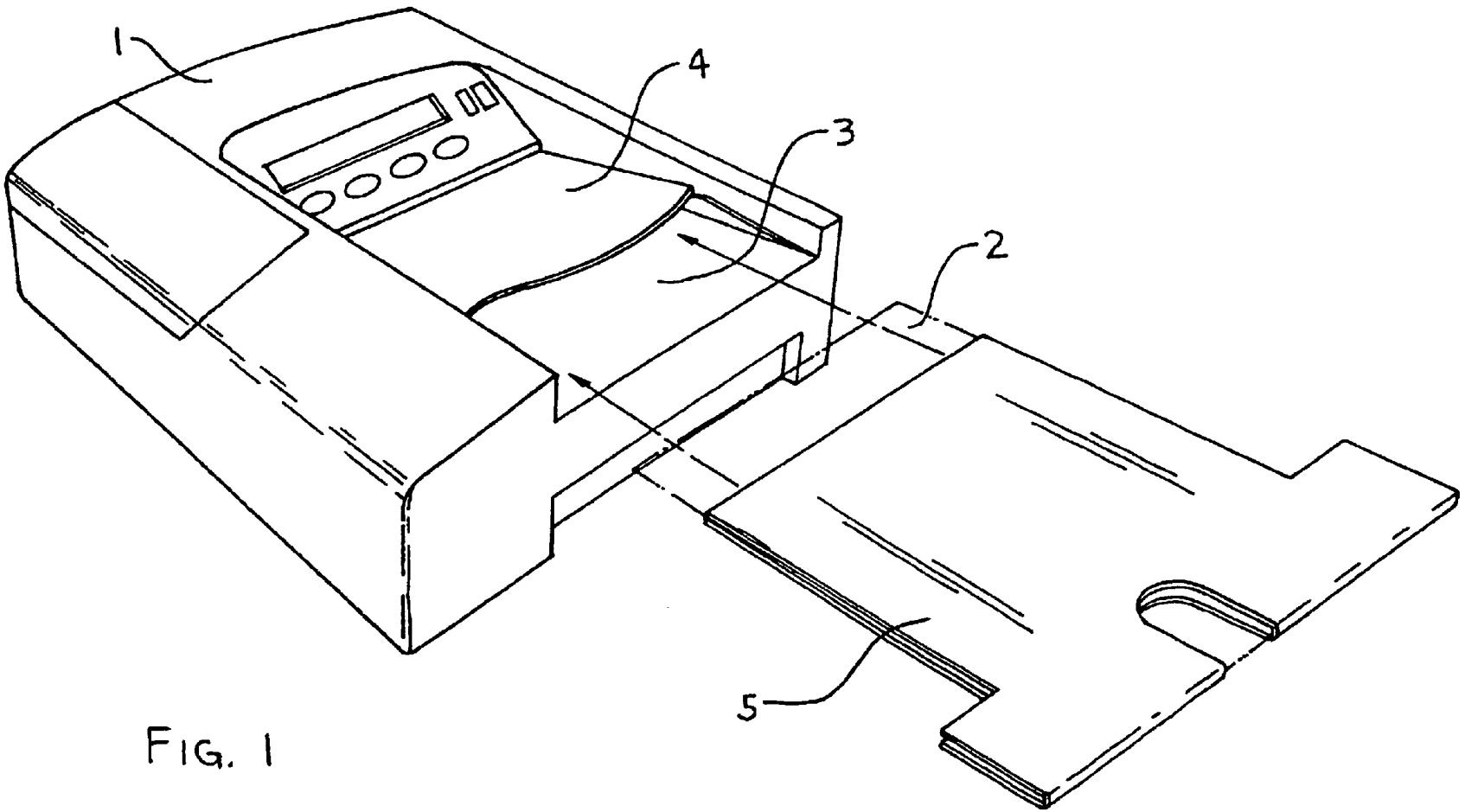
FIG. 1 is a perspective view of the ballot scanning machine, ballot secrecy sleeve and ballot.

A typical ballot-scanning machine 1 is best shown in FIGS. 1 and 4. The scanning machine includes internal electronic scanning devices used to tabulate the voter's choices. These internal electronic scanning tabulating devices are well known in the art and are not part of the disclosure of this invention.

Each ballot scanning machine 1 has a ballot machine-receiving slot 3 located near the front of the machine. This ballot-receiving slot 3 is best shown in FIG. 1. The ballot machine receiving slot 3 has a cover 4 over part of the slot. This ballot machine cover 4 partially shields the ballot 2 (phantom lines) from view as it is being fed into the machine. Normally, the ballot 2 would be fed into the slot 3 and onto the advancing rollers 12 to be scanned and tabulated. However, this procedure destroys the secrecy of the cast ballot as the ballot itself extends above the ballot cover 4 and can be viewed by bystanders. However, use of the ballot secrecy sleeve 5 protects and preserves the secrecy of the entire ballot as will be explained.

Figure 2:
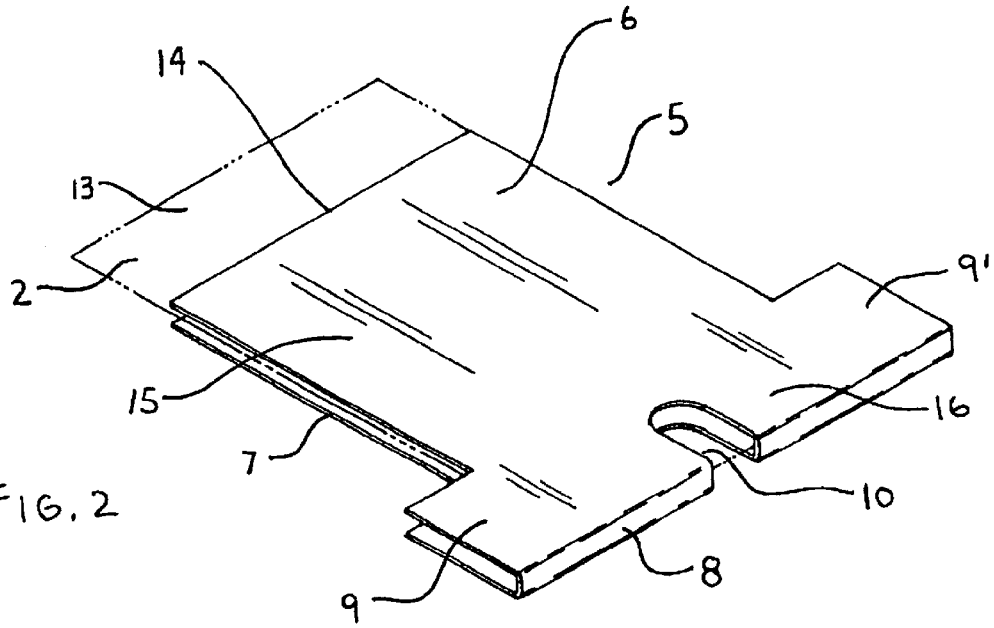
FIG. 2 is a perspective view of the ballot secrecy sleeve shown in its folded and operable condition.
Figure 3:
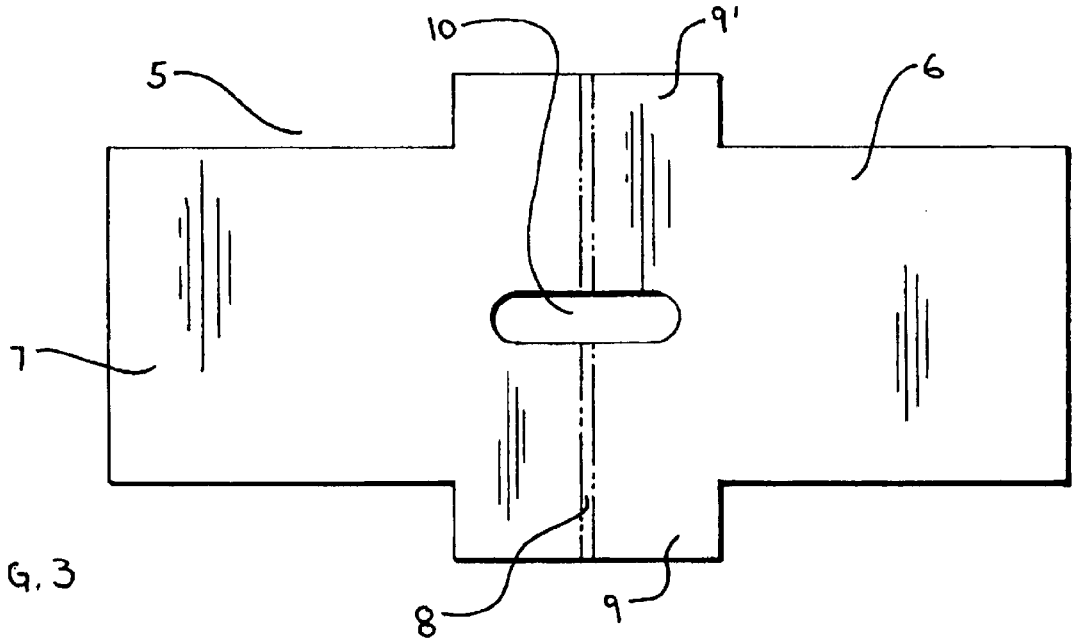
FIG. 3 is a top plan view of the ballot secrecy sleeve shown in its unfolded orientation.

The ballot secrecy sleeve 5 is best shown on FIGS. 2 and 3. This ballot secrecy sleeve 5 is made up of heavy paper or light cardboard having a slick finish. It is cut into the configuration shown in FIGS. 2 and 3. The secrecy sleeve 5 is generally made of slick paper such that the ballot 2 easily slips from between the top 6 and bottom 7 of the ballot secrecy sleeve. In the preferred embodiment, the thickness of the top 6 and bottom 7 of the ballot secrecy sleeve is approximately 1/32 of an inch.

The top 6 and bottom 7 of the ballot secrecy sleeve 5 are identical and are joined at one end by a ballot secrecy sleeve shoulder 8. In the preferred embodiment, this shoulder is approximately 3/16 of an inch. The shoulder 8 joins the top 6 and bottom 7 of the ballot secrecy sleeve to form a T-shaped sleeve having one edge (the shoulder edge) completely closed. The other lower edge 14 of the ballot secrecy sleeve is open. Both the top 6 and bottom 7 sections are flat, as shown.

In the center of the shoulder end of the secrecy sleeve a ballot secrecy sleeve cutout 10 is removed during the manufacturing process. This cutout 10 enables the voter to push the ballot 2 onto the rollers 12 in order for the ballot to be secretly scanned and tabulated.

The ballot sleeve shoulder end also has left 9 and right 9' flanges. The lower part 15 of the T-shaped secrecy sleeve is generally rectangular with the width equal to the size of the ballot 2 and the ballot machine receiving slot 3. The length of the ballot secrecy sleeve is slightly shorter than a ballot to be read in a scanning machine. The shoulder end 16 of the sleeve has left 9 and right 9' flanges that are wider than the width of the lower part 15 of the sleeve. These shoulder end 16 flanges 9 and 9' are adapted to position the ballot and ballot secrecy sleeve correctly into the ballot machine receiving slot 3.

Turning now to FIGS. 4 and 5, the use of the ballot secrecy sleeve is shown. Once the voter has cast his ballot 2, he places the ballot inside the ballot secrecy sleeve 5. The ballot secrecy sleeve covers nearly the entire ballot, with a free end of the ballot 13 protruding slightly outside of the lower edge 14 of the secrecy sleeve, as shown in FIGS. 2 and 5. The free end of the ballot 13 does not contain any candidate's name or voter's cast mark so the entire part of the ballot indicating the candidates and voter's preferences are completely covered by the ballot secrecy sleeve 5.

The ballot 2 and ballot secrecy sleeve 5 are inserted into the ballot machine-receiving slot 3 as shown in FIG. 4. Once this maneuver has been accomplished, the voter's ballot is completely covered and secretly concealed by either the ballot machine slot cover 4 or the ballot secrecy sleeve 5. The top end 17 of the ballot is located in the ballot secrecy sleeve cutout 10, as shown in FIG. 4.

The ballot and ballot sleeve are correctly positioned into the ballot receiving slot 3 based on the geometric configuration of the slot, the left 11 and right 11' sides of the slot, and by the left 9 and right 9' flanges of the ballot secrecy sleeve. As best shown in FIG. 4, the flanges 9 and 9' abut up against the ends of the ballot machine left and right sides 11 and 11' to correctly position the ballot to be scanned and tabulated.

Figure 6:
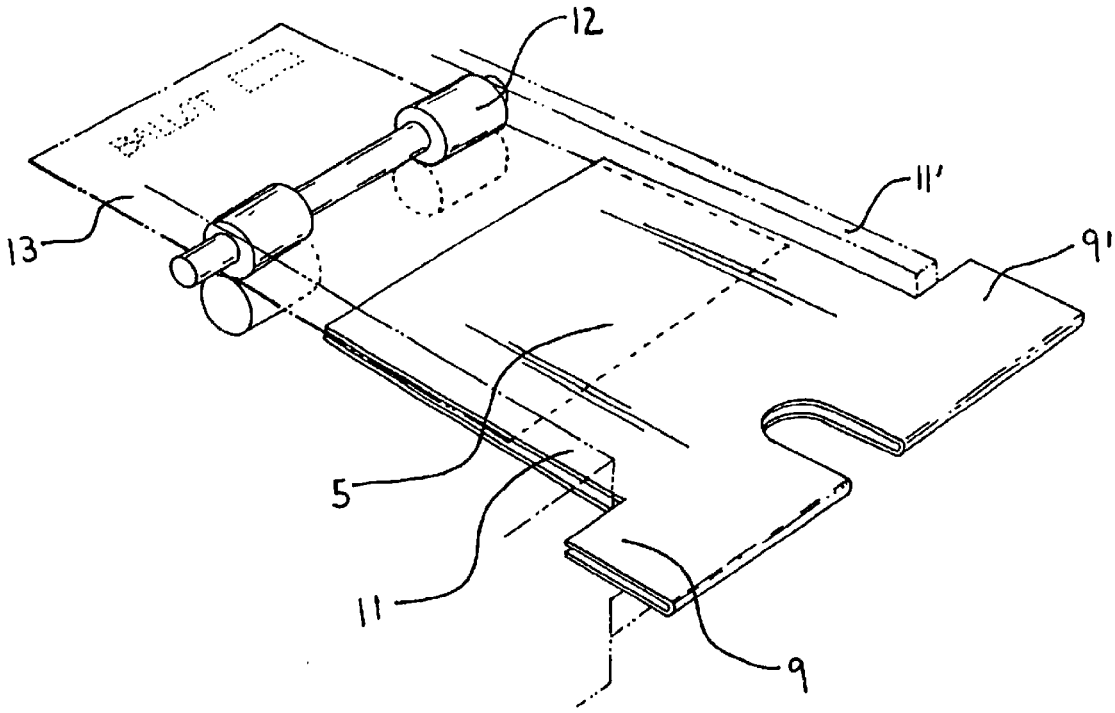
FIG. 6 is a partial cutaway view of the ballot scanning machine, ballot, and ballot secrecy sleeve shown as the ballot is being fed by the rollers into the scanning and tabulating area of the ballot scanning machine.

Once the ballot and ballot sleeve have been positioned as shown in FIG. 4, the voter simply pushes the top end of the ballot 17 in the direction of the arrow 18. Pushing the ballot this way pushes the free end of the ballot 13 into contact with the ballot machine rollers 12. As best shown in FIGS. 5 and 6, these rollers 12 receive the free end of the ballot 13 and pull the entire ballot 2 through the machine, to be scanned and tabulated. Because the ballot secrecy sleeve has a top and a bottom section separated slightly by a shoulder 8, the ballot easily slips out of the ballot secrecy sleeve 5 so that the ballot may be scanned and tabulated. The entire process from start to finish protects and preserves the secrecy of the ballot and the privacy of the voter.

Although ballot scanning and tabulating machines may come in varying sizes and orientations, the preferred embodiment described above can be adequately adapted to the precise dimensions and geometric configurations of all of the scanning and tabulating machines currently in use. While the width of individual ballots may vary from jurisdiction to jurisdiction, these widths can be accommodated by adapting the width of the lower part 15 of the ballot secrecy sleeve or by other adapting means. The preferred embodiment of the ballot secrecy sleeve described herein has a width of the lower part 15 of approximately 8¼ inches. The length of the lower part 15 is also approximately 8¼ inches. The overall width of the shoulder end 16 of the ballot secrecy sleeve is approximately 12 inches in the preferred embodiment while the width of each flange is approximately 3½ inches. The width of the cutout 10 in the preferred embodiment is approximately 1¼ inches while its depth is approximately 2¼ inches. While these dimensions are preferred for this embodiment, it should be noted that the dimensions given are meant as a means of illustration only and not as a limitation. Obviously, other voting machines could have slightly different dimensions. This device can be adapted to fit all scanning and tabulating machines currently on the market while still keeping within the spirit and disclosure of this invention. Further, the selection of the materials as being either thick paper or thin cardboard is meant as a means of illustration only and not as a limitation. Obviously, other types of paper or materials, including plastic or other synthetic materials, could be use while still keeping within the spirit of this disclosure.

The essence of this invention is to provide a ballot secrecy cover for a ballot. The cover will have the dimensions such that it covers the ballot when the ballot is inserted into the ballot-receiving slot of any electronic scanning and tabulating machine.

We claim:

1. A ballot secrecy sleeve for a ballot inserted into a ballot tabulating machine, said machine having an essentially rectangular ballot receiving slot with left and right sides, a ballot machine cover and lower rollers adapted to receive an essentially rectangular ballot, comprising:

(a) an essentially flat ballot sleeve having an upper shoulder connected to front and back ballot covers;

(b) identical front and back covers closed at the upper end by said shoulder and open at the lower end, wherein the upper end of said ballot cover has left and right flanges wider than the slot of a ballot machine, and wherein the lower end of said ballot cover has a width equal to the width of a ballot and slot and a length shorter than the ballot;

(c) said shoulder having a cut-out therein;

wherein the upper flanges of said ballot sleeve abut against the left and right sides of said ballot machine slot and wherein the ballot may be placed in the sleeve and pushed into contact with said ballot machine rollers using said cut-out.

* * * * *